US011072172B2

(12) United States Patent
Kakiuchi et al.

(10) Patent No.: US 11,072,172 B2
(45) Date of Patent: Jul. 27, 2021

(54) LIQUID DISCHARGING HEAD

(71) Applicant: BROTHER KOGYO KABUSHIKI KAISHA, Nagoya (JP)

(72) Inventors: Toru Kakiuchi, Aichi-ken (JP); Yasuo Kato, Aichi-ken (JP); Yuichi Ito, Mie-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/548,539

(22) Filed: Aug. 22, 2019

(65) Prior Publication Data

US 2020/0061993 A1 Feb. 27, 2020

(30) Foreign Application Priority Data

Aug. 24, 2018 (JP) ..... JP2018-157004

(51) Int. Cl.
*B41J 2/14* (2006.01)
*B41J 2/045* (2006.01)

(52) U.S. Cl.
CPC ..... *B41J 2/1433* (2013.01); *B41J 2/04541* (2013.01); *B41J 2/04586* (2013.01); *B41J 2002/14419* (2013.01); *B41J 2002/14491* (2013.01)

(58) Field of Classification Search
CPC .. B41J 2/1433; B41J 2/04586; B41J 2/04541; B41J 2202/20; B41J 2202/21; B41J 2002/14491; B41J 2002/14419; B41J 2/14233; B41J 2202/11; B41J 2002/14241
See application file for complete search history.

(56) References Cited

U.S. PATENT DOCUMENTS

| | | | | |
|---|---|---|---|---|
| 9,981,464 | B2 | 5/2018 | Karita et al. | |
| 2006/0244797 | A1* | 11/2006 | Tajima | B41J 2/1752 347/87 |
| 2007/0120904 | A1* | 5/2007 | Sekiguchi | B41J 2/14209 347/85 |
| 2015/0258786 | A1* | 9/2015 | Akahane | B41J 2/1433 347/65 |
| 2017/0197409 | A1* | 7/2017 | Okushima | B41J 2/14145 |

FOREIGN PATENT DOCUMENTS

| | | |
|---|---|---|
| JP | 2006327176 A | 12/2006 |
| JP | 2015174391 A | 10/2015 |

* cited by examiner

*Primary Examiner* — Yaovi M Ameh
(74) *Attorney, Agent, or Firm* — Baker Botts L.L.P.

(57) ABSTRACT

A liquid discharging head includes a channel member having a nozzle surface formed with first nozzles, second nozzles, third nozzles and fourth nozzles. The channel member is formed with: a first distributing channel communicating with a first storage chamber and extending in a first direction, a second distributing channel communicating with a second storage chamber, extending in the first direction, and arranged side by side to the first distributing channel in a second direction, a first common channel communicating with the first nozzles, a second common channel communicating with the second nozzles, a third common channel communicating with the third nozzles, and a fourth common channel communicating with the fourth nozzles. The first to fourth common channels each extend in a third direction crossing the first and second directions, and partially overlaps with the first and second distributing channels in a fourth direction orthogonal to the nozzle surface.

13 Claims, 14 Drawing Sheets

LIQUID DISCHARGING HEAD

CROSS REFERENCE TO RELATED APPLICATION

The present application claims priority from Japanese Patent Application No. 2018-157004, filed on Aug. 24, 2018, the disclosure of which is incorporated herein by reference in its entirety.

BACKGROUND

Field of the Invention

The present disclosure relates to a liquid discharging head provided with a plurality of nozzles.

Description of the Related Art

There is known a liquid discharging head having a nozzle surface in which nozzles are formed. The nozzles are grouped into four nozzle groups corresponding to four color inks, respectively. Four reservoir (common flow channels or common channels) are provided with respect to the four nozzles groups, respectively; each of the four reservoirs communicates with nozzles, among the nozzles, belonging to one of the nozzle groups corresponding thereto. Each of the four reservoirs extends in a direction along the nozzle surface.

The four reservoirs communicate with four channels (distributing channels), respectively, of a liquid distributing part. The liquid distributing part is provided with six slits through which six flexible wiring boards are inserted, respectively. The four distributing channels are formed to avoid the six slits; each of the four distributing channels has, as seen from a direction orthogonal to the nozzle surface, a comb-teeth like shape including a portion extending in a certain direction the same as the extending direction of the respective reservoirs, and another portion extending in a direction orthogonal to the certain direction and along the nozzle surface.

SUMMARY

In the above-described liquid discharging head, each of the distributing channels has a complex shape as described above, and has a small channel cross-sectional area. In this case, each of the distributing channels might be clogged with any air bubbles, which in turn might cause failure of, or unsatisfactory liquid supply to, the nozzles.

An object of the present disclosure is to provide a liquid discharging head capable of simplifying the configuration of a distribution channel, and capable of preventing any unsatisfactory liquid supply to the nozzles.

According to an aspect of the present disclosure, there is provided a liquid discharging head comprising a channel member having a nozzle surface in which nozzles A1, nozzles A2, nozzles B1 and nozzles B2 are formed, the channel member being formed with: a distributing channel A communicating with a storage chamber A configured to store liquid A and extending in a first direction along the nozzle surface; a distributing channel B communicating with a storage chamber B configured to store liquid B, extending in the first direction, and arranged side by side to the distributing channel A in a second direction orthogonal to the first direction and along the nozzle surface; a common channel A1 communicating with the nozzles A1, extending in a third direction crossing the first and second directions and along the nozzle surface, and having a portion overlapping with the distributing channel A in a fourth direction orthogonal to the nozzle surface and another portion overlapping with the distributing channel B in the fourth direction; a common channel A2 communicating with the nozzles A2, extending in the third direction, and having a portion overlapping with the distributing channel A in the fourth direction and another portion overlapping with the distributing channel B in the fourth direction; a common channel B1 communicating with the nozzles B1, extending in the third direction, and having a portion overlapping with the distributing channel A in the fourth direction and another portion overlapping with the distributing channel B in the fourth direction; a common channel B2 communicating with the nozzles B2, extending in the third direction, and having a portion overlapping with the distributing channel A in the fourth direction and another portion overlapping with the distributing channel B in the fourth direction; a connecting channel A1 connecting the distributing channel A with the common channel A1; a connecting channel A2 connecting the distributing channel A with the common channel A2; a connecting channel B1 connecting the distributing channel B with the common channel B1; and a connecting channel B2 connecting the distributing channel B with the common channel B2, wherein the channel member has a first end which is one end in the second direction and a second end which is the other end in the second direction, the distributing channel A is located, in the second direction, between the first end of the channel member and the distributing channel B, and the connecting channels A1 and A2 are located, in the second direction, between the first end of the channel member and the connecting channels B1 and B2.

According to the present disclosure, it is possible to simplify the configuration of the distribution channel, and to prevent any unsatisfactory liquid supply to the nozzles.

EMBODIMENT

First Embodiment

Figure 1:
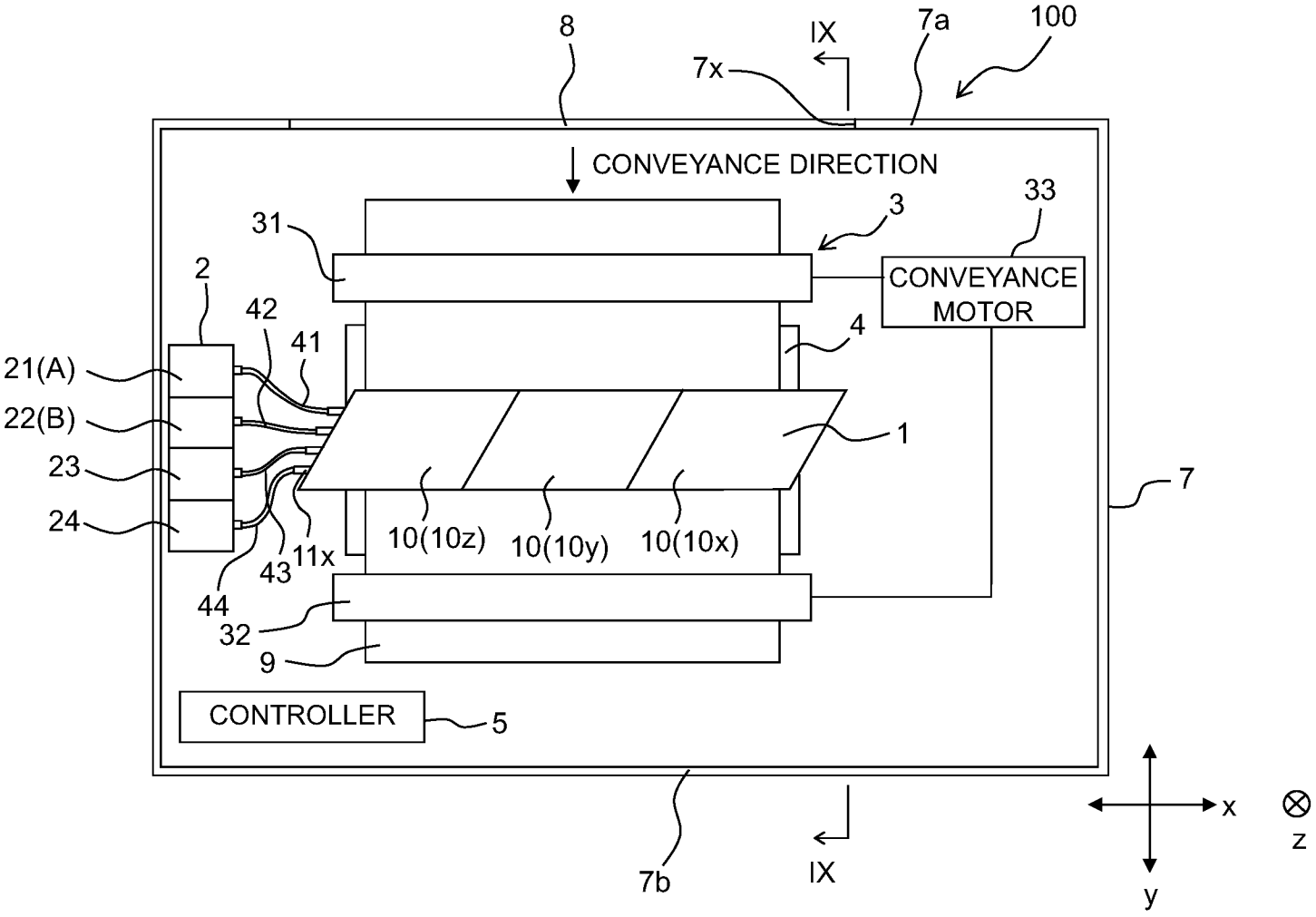
FIG. 1 is a schematic plan view of a printer including a head according to a first embodiment of the present disclosure.

Firstly, an explanation will be given about the schematic configuration of a printer 100 which includes an ink-jet head (hereinafter simply referred to as "head") 1 according to a first embodiment of the present disclosure, with reference to FIG. 1. The printer 100 is provided with a head 1, a conveying mechanism 3, a platen 4, a controller 5 and a casing 7.

The head 1 is a head of the line-system (namely, a system of jetting an ink onto a paper (paper sheet) 9 in a state that the position of the head 1 is fixed), and is elongated in an x-direction orthogonal to a conveyance direction of the paper sheet 9. The head 1 is constructed of three channel members 10 which are arranged side by side in the x-direction. The three channel members 10 have a same configuration. Further, the three channel members 10 are detachably attachable to one another, and are configured such that the three channel members 10 are capable of assuming a mutually connected state (FIG. 1) that the three channel members 10 are connected to one another and a non-connected state (of which illustration is omitted in the drawings) that the three channel members 10 are not connected to one another.

The conveying mechanism 3 has two pairs of rollers 31 and 32. The pairs of rollers 31 and 32 sandwich the head 1 in an y-direction parallel to the conveyance direction. By being driven by a conveyance motor 33, two rollers constructing each of the pair of rollers 31 and 32 are rotated in mutually reverse directions while sandwiching the paper sheet 9 therebetween to thereby convey the paper sheet 9 in the conveyance direction.

The platen 4 is arranged between the pairs of rollers 31 and 32 in the y-direction, at a position below or under the head 1. By driving of the conveying mechanism 3, the paper sheet 9 is conveyed in the conveyance direction while being supported by the platen 4. An ink is discharged (jetted) from the head 1 onto the paper sheet 9 supported by the platen 4.

The controller 5 controls the head 1 and the conveyance motor 33 based on a recording command (instruction) inputted from an external device such as a PC, etc., such that an image, etc., is recorded on the paper sheet 9.

The casing 7 accommodates the head 1, the conveying mechanism 3, the platen 4 and the controller 5 therein. The casing 7 has a first side wall 7*a* constructing one end in the y-direction and a second side wall 7*b* constructing the other end in the y-direction. An opening 7*x* is formed in the first side wall 7*a*. A cover 8 (see FIG. 9), which is capable of assuming a state that the cover 8 allows the opening 7*x* to be opened and a state that the cover 8 closes the opening 7*x*, is attached to the first side wall 7*a*.

The casing 7 further accommodates a cartridge 2 therein. The cartridge 2 includes a storing chamber 21 storing a cyan ink, a storing chamber 22 storing a magenta ink, a storing chamber 23 storing an yellow ink, and a storing chamber 24 storing a black ink.

Next, the channel member 10 constructing the head 1 will be specifically explained, with reference to FIGS. 2 to 9.

The channel member 10 includes a first part 11 and six pieces of a second part 12 (six second parts 12) which are adhered to the lower surface (a surface facing downward in a z-direction) of the first part 11.

The first part 11 is formed, for example, of a resin, and is parallelogram-shaped in a plane orthogonal to the z-direction, as depicted in FIGS. 2 to 5.

Figure 2:
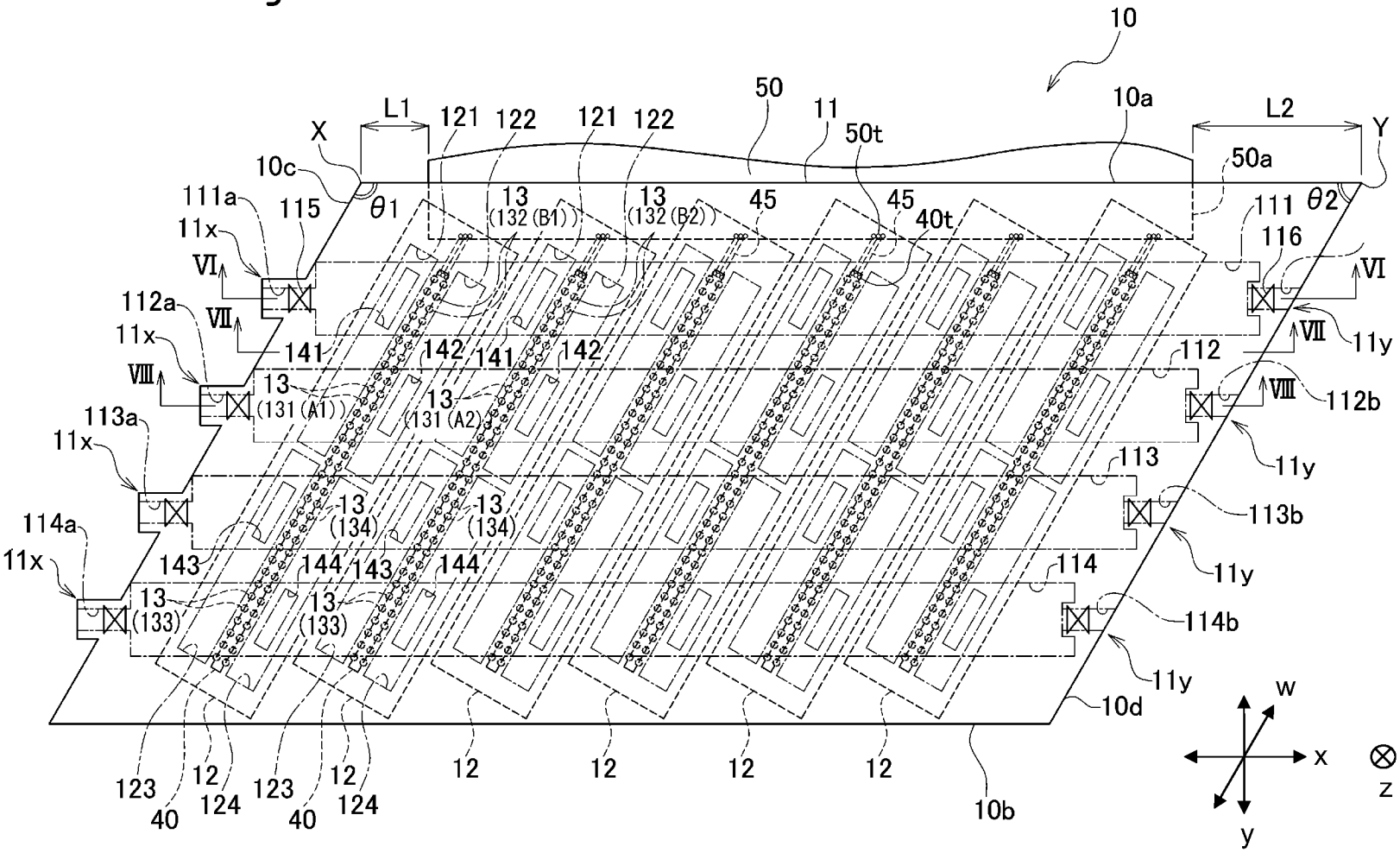
FIG. 2 is a plan view depicting a piece of a channel member included in the head of FIG. 1.
Figure 3:
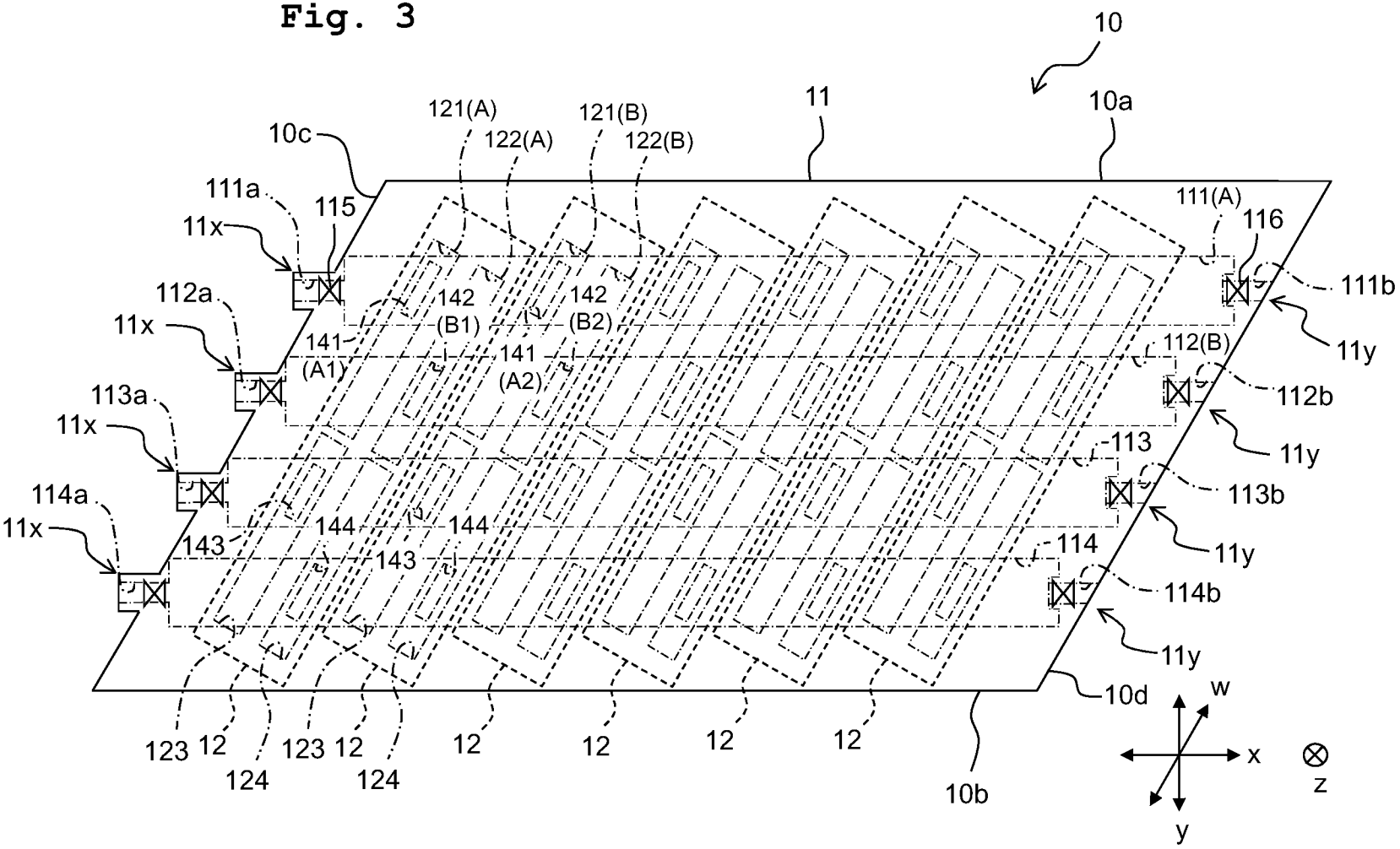
FIG. 3 is a plan view depicting a distributing channel and a common channel in the channel member of FIG. 2.

As depicted in FIGS. 2 and 3, four distributing channels 111 to 114 are formed in the first part 11.

The four distributing channels 111 to 114 each extend in the x-direction, and are arranged side by side in the y-direction. The distributing channels 111 to 114 communicate with the storing chambers 21 to 24 (see FIG. 1), respectively.

The four distributing chambers 111 to 114 have one ends 111*a*, 112*a*, 113*a*, 114 in the x-direction, respectively, and other ends 111*b*, 112*b*, 113*b*, 114*b* in the x-direction, respectively. In the first part 11, certain portions thereof constructing the one ends 111*a*, 112*a*, 113*a*, 114*a* are each convex shaped. In the following, the certain portions are each referred to as a "fitting portion 11*x*". In the first part 11, other portions thereof constructing the one ends 111*b*, 112*b*, 113*b*, 114*b* are each concave shaped. In the following, the other portions are each referred to as a "fitted portion 11*y*". A valve 115 and a valve 116 are provided on the fitting portion 11*x* and the fitted portion 11*y*, respectively. The valve 115 is a check valve. The valve 116 is configured to be opened by the fitting of the fitting portion 11*x* and the fitted portion 11*y*.

In a case that a channel member 10*x* which is included in the three channel members 10 and which is arranged on the rightmost side in FIG. 1 and a channel member 10*y* which is included in the three channel members 10 and which is arranged on the central side in FIG. 1 are in a state of being mutually connected (mutually connected state), four fitting portions 11*x* of the channel member 10*x* are fitted respectively into four fitted portions 11*y* of the channel member 10*y*. In this situation, the valves 116 provided on the four fitted portions 11*y* of the channel member 10*y* are opened, thereby allowing the distributing channels 111 to 114 of the channel member 10*x* to communicate, respectively, with the distributing channels 111 to 114 of the channel member 10*y*. Also in this situation, the distributing channels 111 to 114 of the channel member 10*x* are arranged side by side to the distributing channels 111 to 114 of the channel member 10*y*, respectively, in the x-direction.

In a case that the channel member 10*y* and a channel member 10*z* which is included in the three channel members 10 and which is arranged on the leftmost side in FIG. 1 are in are in a state of being mutually connected (mutually connected state), the four fitting portions 11*y* of the channel member 10*y* are fitted respectively into four fitted portions 11*z* of the channel member 10*z*. In this situation, the valves 116 provided on the four fitted portions fly of the channel member 10*z* are opened, thereby allowing the distributing channels 111 to 114 of the channel member 10*y* to communicate, respectively, with the distributing channels 111 to 114 of the channel member 10*z*. Also in this situation, the distributing channels 111 to 114 of the channel member 10*y* are arranged side by side to the distributing channels 111 to 114 of the channel member 10*z*, respectively, in the x-direction.

In a case that the channel member 10*x* and the channel member 10*y* are in a state of not being communicated with each other (non-communicated state), the four fitting portions 11*x* of the channel member 10*x* are not fitted respectively into the four fitted portions fly of the channel member 10*y*. In this situation, the valves 116 provided on the four fitted portions 11*y* of the channel member 10*y* are closed, and thus the distributing channels 111 to 114 of the channel member 10*x* are not allowed to communicate, respectively, with the distributing channels 111 to 114 of the channel member 10*y*.

In a case that the channel member 10*y* and the channel member 10*z* are in a state of not being communicated with each other (non-communicated state), the four fitting portions 11*x* of the channel member 10*y* are not fitted respectively into four fitted portions 11*y* of the channel member 10*z*. In this situation, the valves 116 provided on the four fitted portions fly of the channel member 10*z* are closed, and thus the distributing channels 111 to 114 of the channel member 10*y* are not allowed to communicate, respectively, with the distributing channels 111 to 114 of the channel member 10*z*.

One ends of tubes 41 to 44 (see FIG. 1) are detachably attachable to the four fitting portions 11*x*, respectively, of the channel member 10*z*. The other ends of the tubes 41 to 44 are communicated with the storing chambers 21 to 24, respectively. In a case that the one ends of the tubes 41 to 44 are attached respectively to the four fitting portions 11*x* of the channel members 10*z*, the storing chambers 21 to 24 are communicated with the distributing channels 111 to 114 of the channel member 10*z*, via the tubes 41 to 44, respectively.

In a case that the one ends of the tubes 41 to 44 are attached to the fitting portions 11*x* of the channel member 10*z* and that the three channel members 10 (10*x*, 10*y* and 10*z*) are in the mutually connected state, the inks inside the storing chambers 21 to 24 flow through the tubes 41 to 44 and are supplied to the four distributing channels 111 to 114 of the channel member 10*z*. Then, the inks are sequentially supplied from the four distributing channels 111 to 114 of the channel member 10*z* to the four distributing channels 111 to 114 of the channel member 10*y*, and then to the four distributing channels 111 to 114 of the channel member 10*x*. Note that in this situation, the valves 116 provided on the four fitted portions 11*y* of the channel member 10*x* are in the closed state, thereby preventing any leakage of the inks from the four fitted portions 11*y* of the channel member 10*x*.

As depicted in FIGS. 2 and 3, in addition to the four distributing channels 111 to 114, the first part 11 is formed with: six holes 141 connecting the distributing channels 111 with six common channels 121; six holes 142 connecting the distributing channels 112 with six common channels 122; six holes 143 connecting the distributing channels 113 with six common channels 123; and six holes 144 connecting the distributing channels 114 with six common channels 124. Each of the holes 141, the holes 142, the holes 143 and the holes 144 are arranged in the x-direction with a predetermined spacing distance (interval) therebetween.

The common channels 121 to 124 are provided as six common channels 121, six common channels 122, six common channels 123 and six common channels 124, corresponding to the six second parts 12, respectively. The four common channels 121 to 124 are formed in each of the six second parts 12.

The distributing channel 111 is communicated with the six common channels 121 via the six holes 141, respectively. The distributing channel 112 is communicated with the six common channels 122 via the six holes 142, respectively. The distributing channel 113 is communicated with the six common channels 123 via the six holes 143, respectively. The distributing channel 114 is communicated with the six common channels 124 via the six holes 144, respectively.

Here, the channel member 10 has a first end 10*a* which is one end in the y-direction, a second end 10*b* which is the other end in the y-direction, a third end 10*c* which is one end in the x-direction, and a fourth end 10*d* which is the other end in the x-direction. The first to fourth ends 10*a* to 10*d* are constructed of end portions of the first part 11.

The distributing channel 111 is located, in the y-direction, between the first end 10*a* and the distributing channels 112 to 114. The distributing channel 112 is located, in the y-direction, between the first end 10*a* and the distributing channels 113 and 114. The distributing channel 113 is located, in the y-direction, between the first end 10*a* and the distributing channel 114.

The six holes 141 are located, in the y-direction, between the first end 10*a* and the six holes 142, six holes 143 and six holes 144. The six holes 142 are located, in the y-direction, between the first end 10*a* and the six holes 143 and six holes 144. The six holes 143 are located, in the y-direction, between the first end 10*a* and the six holes 144.

Figure 6:
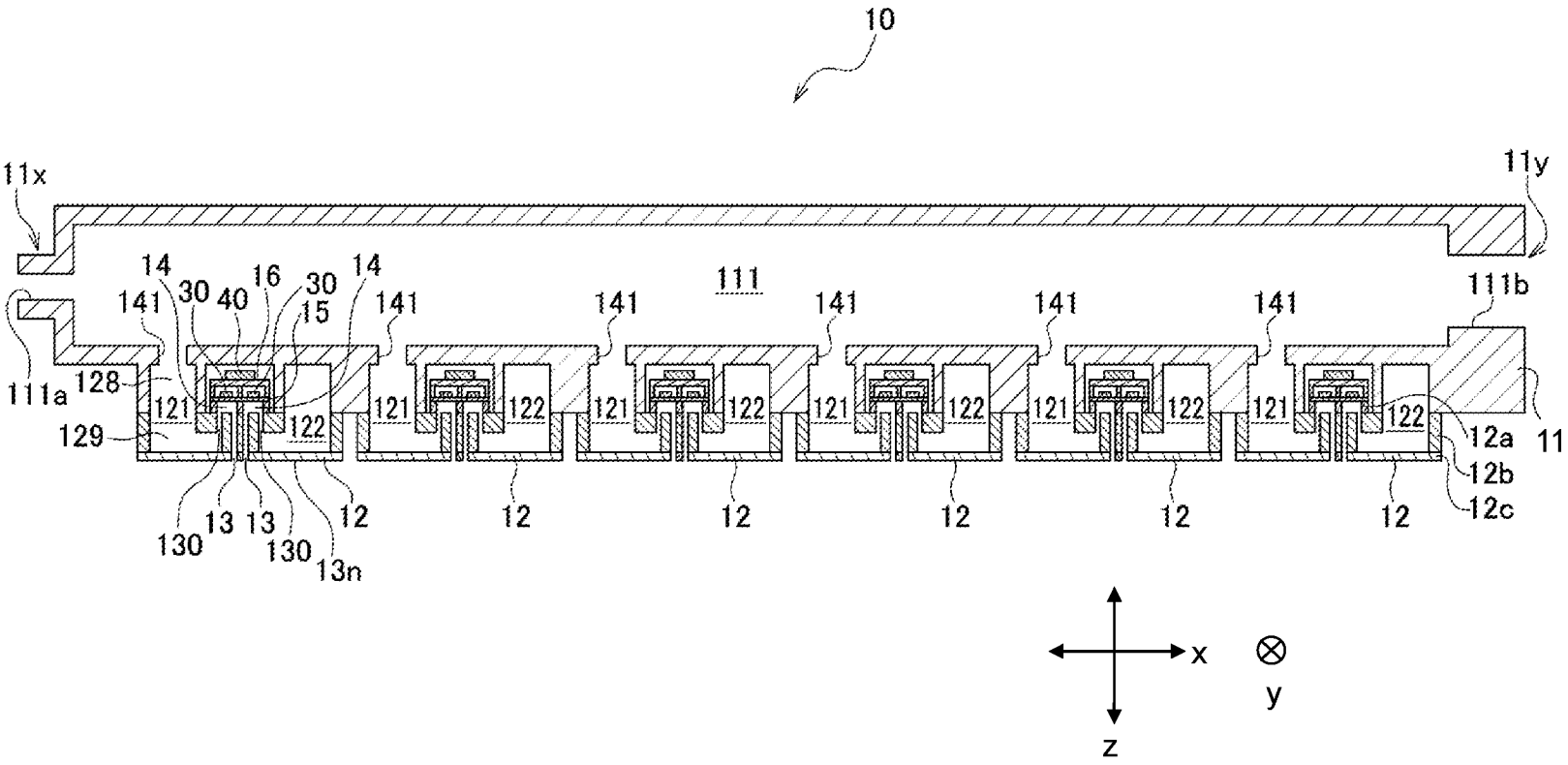
FIG. 6 is a cross-sectional view of the channel member, taken along a line VI-VI in FIG. 2.
Figure 7:
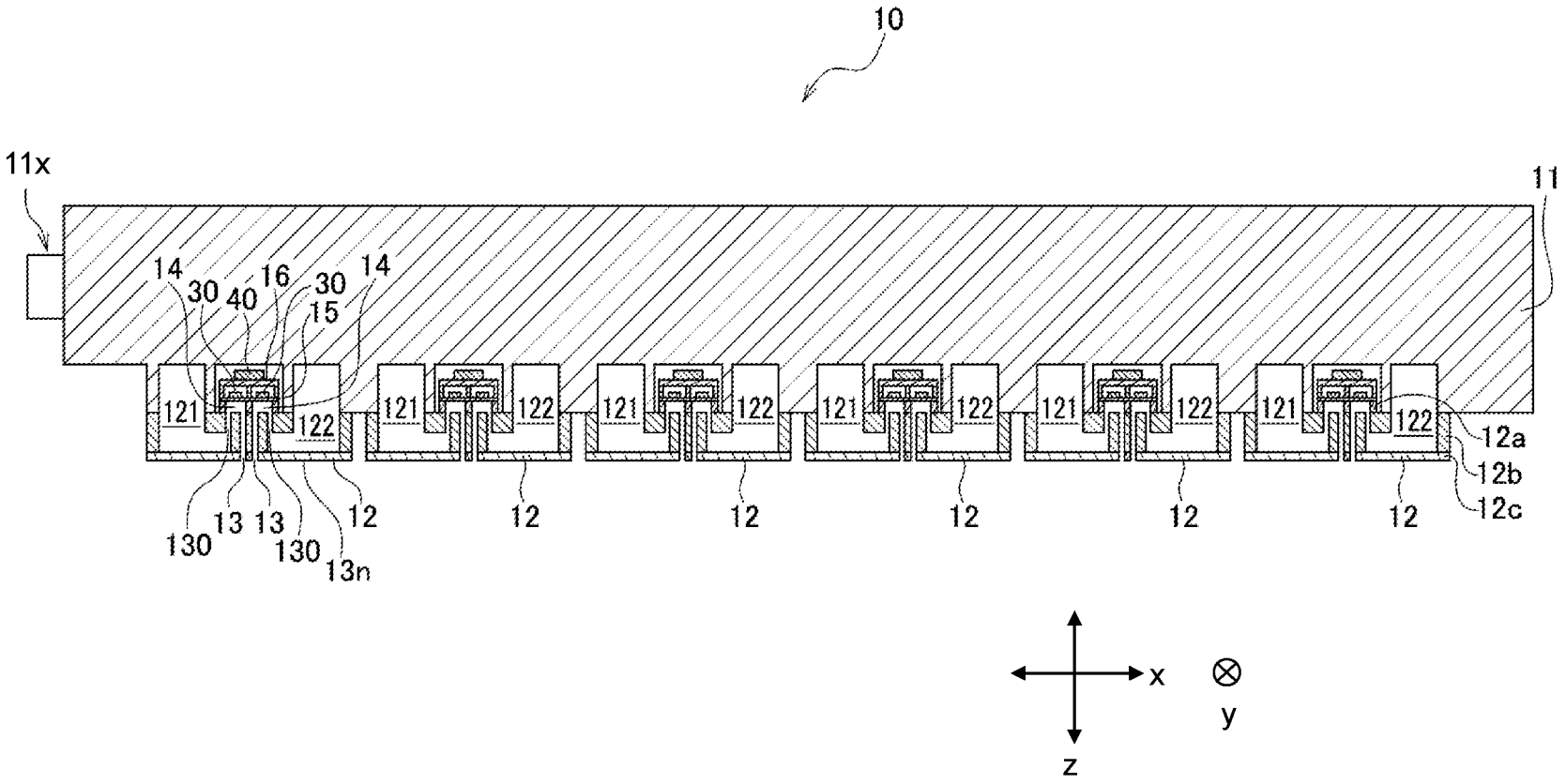
FIG. 7 is a cross-sectional view of the channel member, taken along a line VII-VII in FIG. 2.
Figure 8:
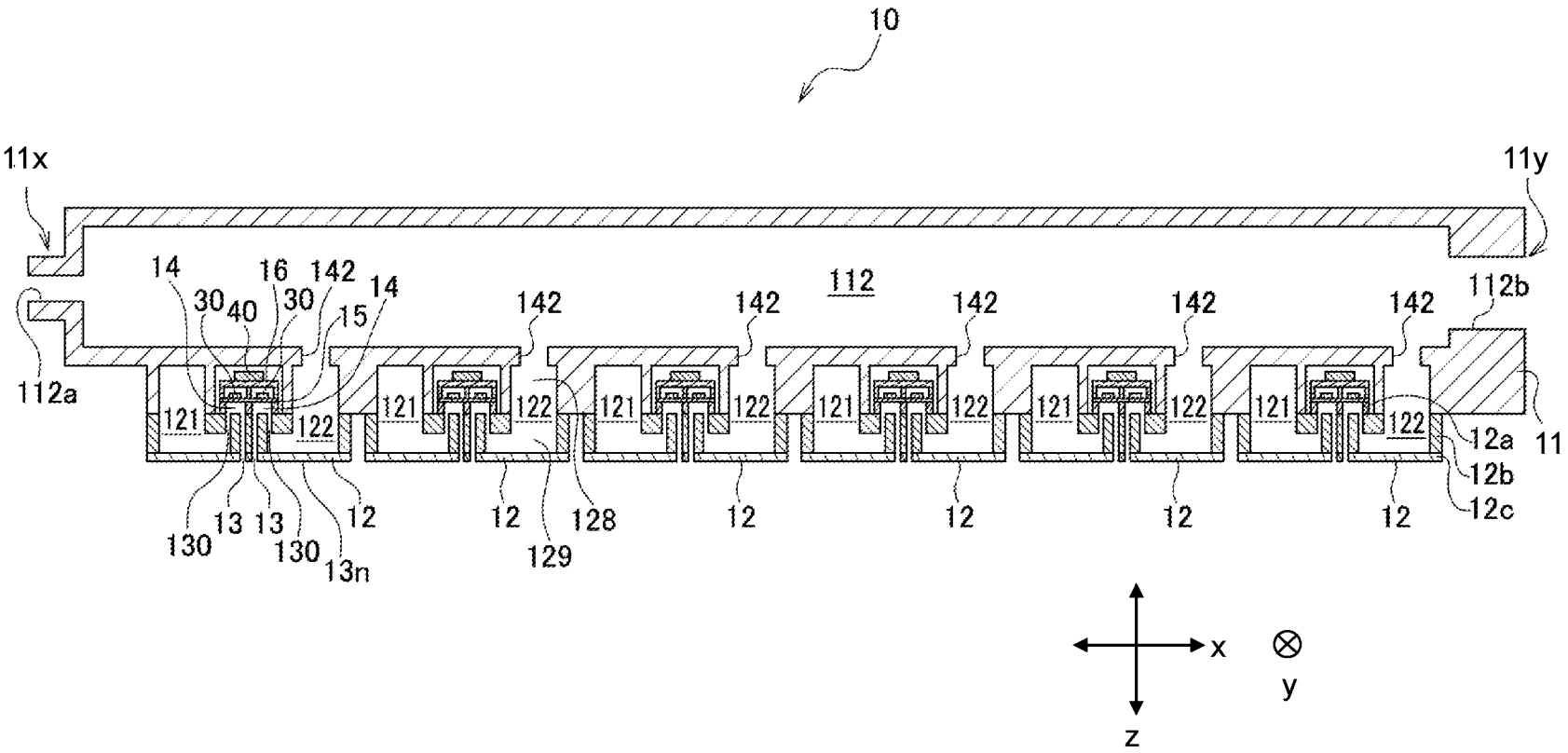
FIG. 8 is a cross-sectional view of the channel member, taken along a line VIII-VIII in FIG. 2.

The first part 11 is further formed with communicating portions 128 for (to) each of the common channels 121 to 124, as depicted in FIGS. 6 to 8. The communicating portions 128 are portions communicating with the holes 141 to 144, in the common channels 121 to 124, respectively.

The six second parts 12 are each formed with lined-up portions 129 of each of the four common channels 121 to 124. The lined-up portions 129 are portions which are lined up (arranged side by side) in the z-direction with the communicating portions 128 in the common channels 121 to 124, respectively.

In other words, the common channels 121 to 124 include the communicating portions 128 arranged immediately below the holes 141 to 144, respectively; and the lined-up portions 129 which are arranged immediately below the communicating portions 128, respectively. Each of the communicating portions 128 is arranged, in the z-direction, between one of the lined-up portions 129 and one of the holes 141 to 144 corresponding thereto. The communicating portions 128 and the lined-up portions 129 have substantially same sizes and shapes.

The six second parts 12 have a same configuration. The six second parts 12 each have a rectangular shape which is elongated in a w-direction in a plane orthogonal to the z-direction, and are arranged side by side in the x-direction at equal intervals therebetween, as depicted in FIGS. 2 to 5. Further, in a case that the three channel members 10 are in the mutually connected state, the second parts 12 which are included in the three channel members 10 and of which total number is 18 (eighteen) are arranged in the x-direction at equal intervals therebetween. Accordingly, in the head 1, as a whole, including the three channel members 10, the nozzles 13 are arranged side by side in the x-direction at equal intervals therebetween.

Figure 4:
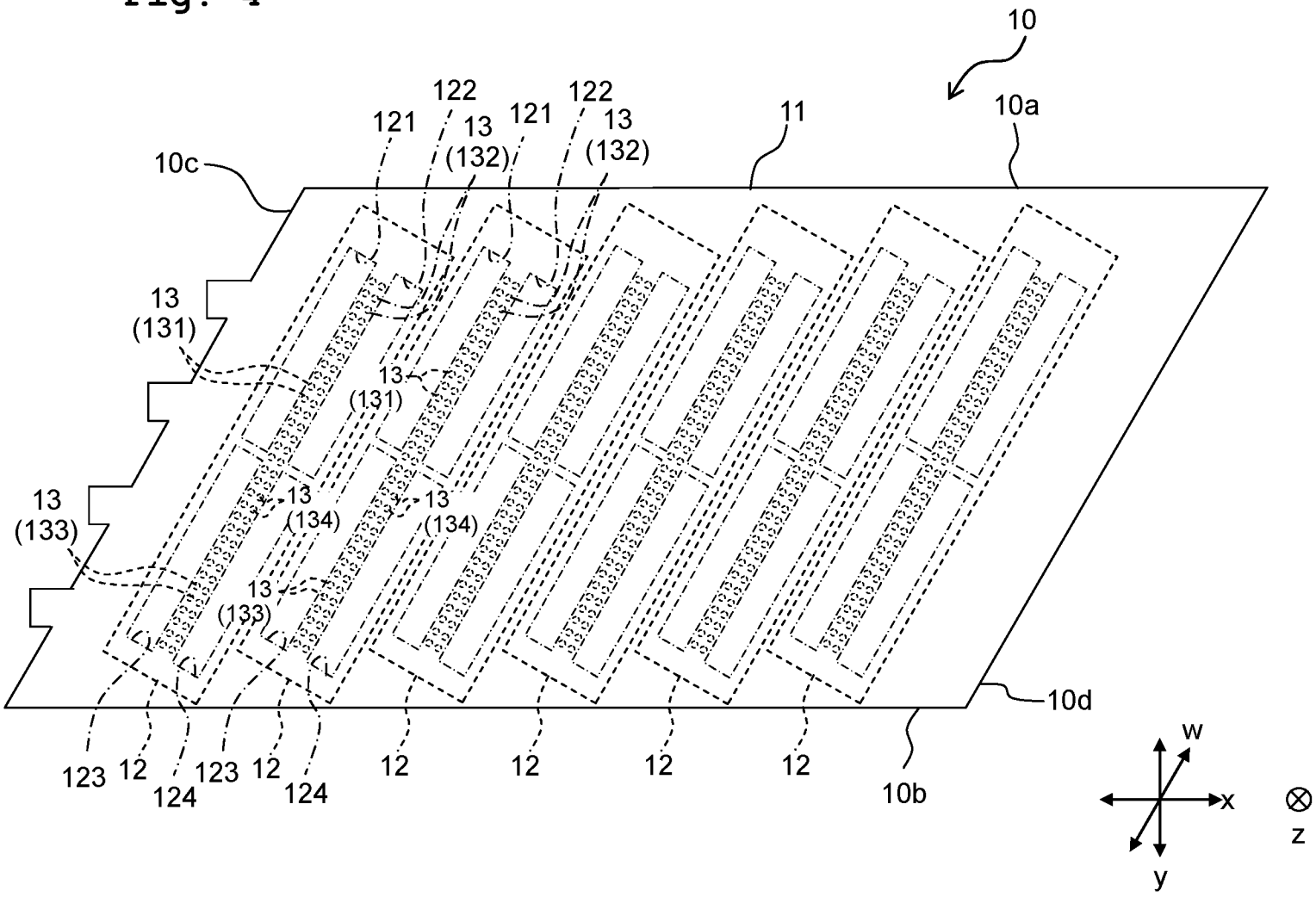
FIG. 4 is a plan view depicting the common channel and nozzles in the channel member of FIG. 2.

In each of the six second parts 12, the four common channels 121 to 124 extend in the w-direction, as depicted in FIGS. 2 to 4. The common channel 121 and the common channel 123 are arranged side by side in the w-direction, and forms an array (row) along the w-direction. The common channel 122 and the common channel 124 are arranged side by side in the w-direction, and forms an array along the w-direction. These two arrays are arranged side by side in the x-direction.

The common channel 121 has portions overlapping with the distributing channels 111 and 112, respectively, in the z-direction. The common channel 122 has portions overlapping with the distributing channels 111 and 112, respectively, in the z-direction. The common channel 123 has portions overlapping with the distributing channels 113 and 114, respectively, in the z-direction. The common channel 124 has portions overlapping with the distributing channels 113 and 114, respectively, in the z-direction.

In addition to the lined-up portions 129 of the common channels 121 to 124, each of the six second parts 121 is formed with individual channels 130 which are formed corresponding to the nozzles 13, respectively; the individual channels 130 reach the nozzles 13, respectively, each from an outlet formed in one of the common channels 121 to 124, via a pressure chamber 14.

The lower surface of each of the second parts 12 is formed with sixteen pieces of nozzle 131 communicating with the common channel 121, sixteen pieces of nozzle 132 communicating with the common channel 122, sixteen pieces of nozzle 133 communicating with the common channel 123, and sixteen pieces of nozzle 134 communicating with the common channel 124. The lower surface of each of the second parts 12 is a nozzle surface 13*n* which has sixty-four pieces of the nozzle 13 formed therein.

The x-direction is a direction along the nozzle surface 13*n*, and corresponds to a "first direction" of the present disclosure. The y-direction is a direction orthogonal to the x-direction and along the nozzle surface 13*n*, and corresponds to a "second direction" of the present disclosure. The w-direction is a direction crossing the x-direction and the y-direction and along the nozzle surface 13*n*, and corresponds to a "third direction" of the present disclosure. The z-direction is a direction orthogonal to the nozzle surface 13*n*, and corresponds to a "fourth direction" of the present disclosure.

The six second parts 12 are each constructed of three plates 12*a* to 12*c* which are stacked in the z-direction, as depicted in FIGS. 6 to 8. A plurality of pieces of the pressure chamber 14 are formed in the plate 12*a*. The lined-up portions 129 of the common channels 121 to 124 are formed in the plate 12*b*. The nozzles 13 are formed in the plate 12*c*.

A vibration plate 15 is arranged on the upper surface of the plate 12*a*. Piezoelectric elements 30 are placed on the upper surface of the vibration plate 15 at a location thereof at which each of the piezoelectric elements 30 faces one of the pressure chambers 14. Each of the piezoelectric elements 30 corresponds to a "driving element" of the present disclosure, and is provided with respect to one of the pressure chambers 14 (namely, with respect to one of the nozzles 13).

A cover plate 16 is arranged on the upper surface of the vibration plate 15. Recessed parts configured to store the piezoelectric elements 30 therein are formed in the lower surface of the cover plate 16.

A driver IC 40 is arranged on the upper surface of the cover plate 16. The driver IC 40 corresponds to a "driving circuit" of the present disclosure, and is electrically connected to sixty-four pieces of the piezoelectric element 30 provided on the vibration plate 15.

Figure 5:
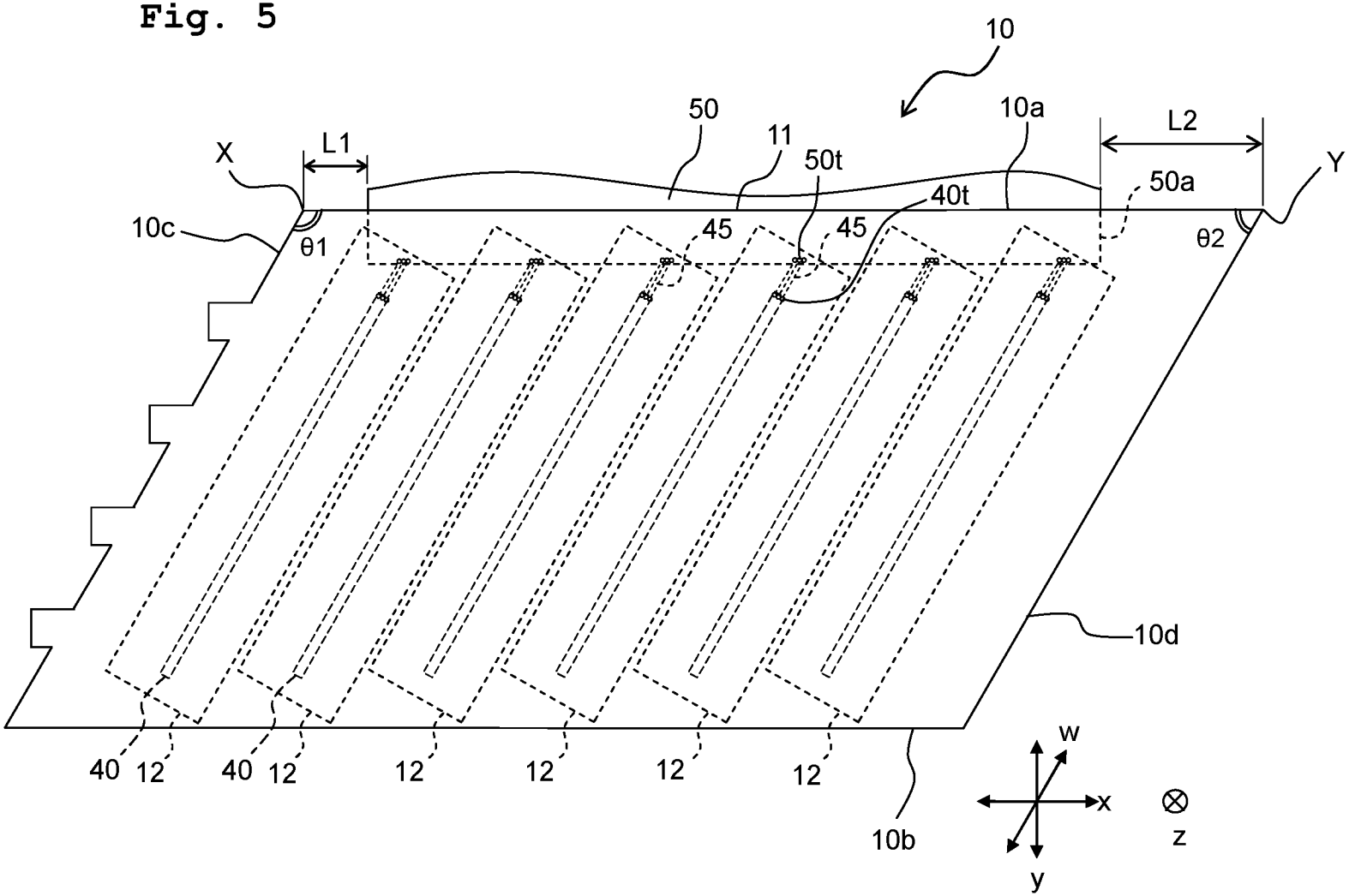
FIG. 5 is a plan view depicting a driver IC, a wiring and an FPC in the channel member of FIG. 2.

The driver IC 40 is provided as six driver ICs 40 provided individually on the six second parts 12, respectively; as depicted in FIGS. 2 and 5, the six driver ICs 40 each extend in the w-direction and are arranged side by side in the x-direction. The six driver ICs 40 provided on the six second parts 12, respectively, are connected to one end 50*a* of a FPC (Flexible Printed Circuit) 50 via wirings 45. Terminals 50*t* of the FPC 50 are provided on the one end 50*a*. One end of each of the wirings 45 is connected to one of the terminals 50*t*, and the other end of each of the wirings 45 is connected to a terminal 40*t* of one of the driver ICs 40.

The one end 50*a* of the FPC 50 is located, in the y-direction, between the first end 10*a* of the channel 10 and the distributing channels 111 to 114, as depicted in FIG. 2. The FPC 50 is drawn from the one end 50*a* in a direction from the distributing channels 111 to 114 toward the first end 10*a*, along the y-direction.

Here, an angle θ1 defined by the first end 10*a* and the third end 10*c* is an obtuse angle, and an angle θ2 defined by the first end 10*a* and the fourth end 10*d* is an acute angle. Further, a distance L1 in the x-direction from a connection portion X between the first end 10*a* and the third end 10*c* to the one end 50*a* of the FPC 50 is smaller than a distance L2 in the x-direction from a connection portion Y between the first end 10*a* and the fourth end 10*d* to the one end 50*a* of the FPC 50.

Figure 9:
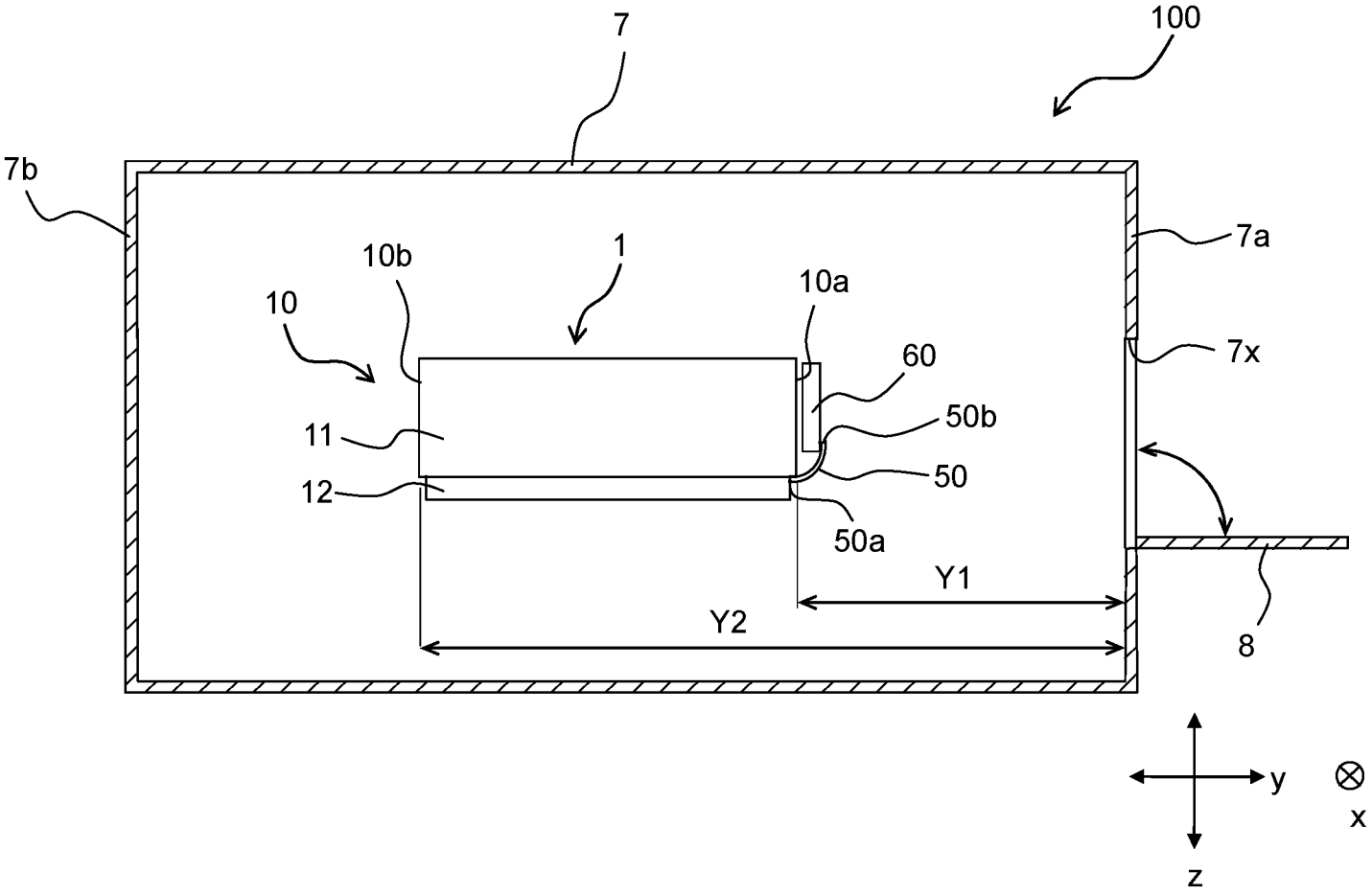
FIG. 9 is a cross-sectional view of the printer, taken along a line IX-IX in FIG. 1.

The other end 50*b* of the FPC 50 is connected to a wiring substrate (wiring circuit board) 60, as depicted in FIG. 9. The wiring substrate 60 is arranged on a side lateral to the channel member 10, and is located at a position at which the wiring substrate 60 sandwiches, in the y-direction, the first end 10*a* of the channel member 10, between the wiring substrate 60 and the distributing channels 111 to 114 (in a direction in which the FPC 50 is drawn relative to the channel member 10 in FIG. 2). A separation distance Y1 in the y-direction between the first end 10*a* of the channel member 10 and the first side wall 7*a* of the casing 7 is smaller than a separation distance Y2 in the y-direction between the second end 10*b* of the channel member 10 and the first side wall 7*a* of the casing 7.

The FPC 50 and the wiring substrate 60 are provided individually with respect to each of the three channel members 10.

In a case that a control signal is supplied from the controller 5 (see FIG. 1) to the driver IC 40 via the wiring substrate 60 and the FPC 50, the driver IC 40 supplies a driving signal with respect to each of the piezoelectric elements 30. Accompanying with this, each of the piezoelectric elements 30 is deformed to thereby apply the pressure to the ink inside one of the pressure chambers 14 corresponding thereto, which in turn allows the ink to be discharged from the nozzle 13 corresponding to one of the pressure chambers 14.

According to the present embodiment, each of the distributing channels 111 to 114 extends in the x-direction and has a simple configuration, as depicted in FIG. 2. Further, by allowing each of the distributing channels 111 to 114 to have a large channel cross-sectional area, it is possible to suppress any clogging of air bubbles and to prevent any unsatisfactory supply of the ink to the nozzles 13.

In the present embodiment, for example, the storing chamber 21 corresponds to a "storing chamber A", the distributing channel 111 corresponds to a "distributing channel A"; the storing chamber 22 corresponds to a "storing chamber B"; the distributing channel 112 corresponds to a "distributing channel B"; common channels 121 which are formed in two second parts 12 among the six second parts 12 correspond to a "common channel A1" and a "common channel A2", respectively; common channels 122 which are formed in the two second parts 12 correspond to a "common channel B1" and a "common channel B2", respectively; nozzles 131, formed in the two second parts 12 and corresponding to the common channels A1 and A2 (121), respectively, corresponds to "nozzles A1" and "nozzles A2", respectively; nozzles 132, formed in the two second parts 12 and corresponding to the common channels B1 and B2 (122), respectively, corresponds to "nozzles B1" and "nozzles B2", respectively; the holes 141, which connect the distributing channel 111 with the common channels 121 formed in the two second parts 12, correspond to a "connecting channel A1" and a "connecting channel A2", respectively; and the holes 142, which connect the distributing channel 112 with the common channels 122 formed in the two second parts 12, correspond to a "connecting channel B1" and a "connecting channel B2", respectively. In the above-described case, the distributing channel 111 is located at a position, in the y-direction, between the first end 10*a* of the channel member 10 and the distributing channel 112. The holes 141 are located at a position, in the y-direction, between the first end 10*a* of the channel member 10 and the holes 142. Further, in above-described case, the common channels 122 (note that the common channel 122 arranged at the right end in FIG. 2 is excluded) are each located at a position, in the x-direction, between two pieces of the common channel 121, and the common channels 121 (note that the common channel 121 arranged at the left end in FIG. 2 is excluded) are each located at a position, in the x-direction, between two pieces of the common channel 122.

Further, in the present embodiment, for example, the storing chamber 23 corresponds to the "storing chamber A", the distributing channel 113 corresponds to the "distributing channel A"; the storing chamber 24 corresponds to the "storing chamber B"; the distributing channel 114 corresponds to the "distributing channel B"; common channels 123 which are formed in two second parts 12 among the six second parts 12 correspond to the "common channel A1" and the "common channel A2", respectively; common channels 124 which are formed in the two second parts 12 correspond to the "common channel B1" and the "common channel B2", respectively; nozzles 133, formed in the two second parts 12 and corresponding to the common channels A1 and A2 (123), respectively, corresponds to the "nozzles A1" and the "nozzles A2", respectively; nozzles 134, formed in the two second parts 12 and corresponding to the common channels B1 and B2 (124), respectively, corresponds to the "nozzles B1" and the "nozzles B2", respectively; the holes 143, which connect the distributing channel 113 with the common channels 123 formed in the two second parts 12, correspond to the "connecting channel A1" and the "connecting channel A2", respectively; and the holes 144, which connect the distributing channel 114 with the common channels 124 formed in the two second parts 12, correspond to the "connecting channel B1" and the "connecting channel B2", respectively. In the above-described case, the distributing channel 113 is located at a position, in the y-direction, between the first end 10*a* of the channel member 10 and the distributing channel 114. The holes 143 are located at a position, in the y-direction, between the first end 10*a* of the channel member 10 and the holes 144. Further, in above-described case, the common channels 124 (note that the common channel 124 arranged at the right end in FIG. 2 is excluded) are each located at a position, in the x-direction, between two pieces of the common channel 123, and the common channels 123 (note that the common channel 123 arranged at the left end in FIG. 2 is excluded) are each located at a position, in the x-direction, between two pieces of the common channel 124.

In a case that the wiring substrate 60 is arranged, in the z-direction, between the distributing channels 111 to 114 and the common channels 121 to 124, and that the ink is leaked between the distributing channels 111 to 114 and the common channels 121 to 124, the leaked ink might adhere to the wiring substrate 60 and might cause any short circuit. In contrast, in the present embodiment, the wiring substrate 60 is located at a position at which the wiring substrate 60 sandwiches, in the y-direction, the first end 10*a* of the channel member 10 between the wiring substrate 60 and the distributing channels 111 to 114, as depicted in FIG. 9. Accordingly, even in such a case that any leakage of ink occurs between the distributing channels 111 to 114 and the common channels 121 to 124, the leaked ink is less likely to adhere to the wiring substrate 60, which in turn suppress the occurrence of any short circuit.

In such a configuration that the FPC 50 is drawn in the z-direction while passing between the distributing channels 111 and 112 or between the distributing channels 113 and 114, it is necessary to secure an area in which the FPC 50 is arranged. Therefore, it is difficult to increase the channel cross-sectional areas of the distributing channels 111 and 112 or of the distributing channels 113 and 114. In contrast, in the present embodiment, the one end 50*a* of the FPC 50 is located, in the y-direction, at the position between the first end 10*a* of the channel member 10 and the distributing channels 111 to 114, as depicted in FIG. 2. Further, the FPC 50 is drawn from the one end 50*a* in a direction from the distributing channels 111 to 114 toward the first end 10*a* of the channel member 10, along the y-direction. The configuration as described above is capable of solving the above-described problem.

As depicted in FIG. 2, the angle θ1 defined by the first end 10*a* and the third end 10*c* is an obtuse angle, and the angle θ2 defined by the first end 10*a* and the fourth end 10*d* is an acute angle. Further, the distance L1 in the x-direction from the connection portion X between the first end 10*a* and the third end 10*c* to the one end 50*a* of the FPC 50 is smaller than the distance L2 in the x-direction from the connection portion Y between the first end 10*a* and the fourth end 10*d* to the one end 50*a* of the FPC 50. In this case, in the part at which the angle θ1 as the obtuse angle is located (the connection portion X between the first end 10*a* and the third end 10*c*), it is possible to secure a large connection area for the FPC 50, thereby making it possible to arrange the FPC 50 in a compact manner.

As depicted in FIG. 9, the separation distance Y1 in the y-direction between the first end 10*a* of the channel member 10 and the first side wall 7*a* of the casing 7 is smaller than the separation distance Y2 in the y-direction between the second end 10*b* of the channel member 10 and the first side wall 7*a* of the casing 7. In this case, the vector of the direction from the channel member 10 toward the opening 7*x* is coincident with the vector of the direction in which the FPC 50 is drawn from the channel member 10. Therefore, the FPC 50 is easily accessed by opening the cover 8 and via the opening 7*x*, and thus an operation regarding the FPC 50 (maintenance operation, etc.) can be easily performed.

As depicted in FIGS. 6 to 8, the channel member 10 includes: the first part 11 which is formed with the distributing channels 111 to 114 and the communicating portions 128 for (to) the common channels 121 to 124; and the second parts 12 each of which is formed with the lined-up portions 129 of the four common channels 121 to 124. Since the distributing channels 111 to 114 and the communicating portions 128 are constructed of a single part (first part 11), it is possible to alleviate such a problem of occurrence of any unsatisfactory introduction of the ink from the distributing channels 111 to 114 to the common channels 121 to 124, which might otherwise be occurred due to any positional deviation between a plurality of parts (provided that the distributing channels 111 to 114 and the communicating portions 128 are constructed of a plurality of parts).

The head 1 is provided with the three channel members 10 each of which has the fitting portions 11*x* and the fitted portions 11*y*, and which are detachably attachable to one another via the fitting portions 11*x* and the fitted portions 11*y*. According to this configuration, even in a case that one or two piece(s) of the three channel members 10 has (have) any failure or problem, it is possible to exchange or perform maintenance of the one or two channels member(s) 10 having the failure or problem occurring therein, rather than discarding all the three channel members 10, which is thus economical.

Second Embodiment

Figure 10:
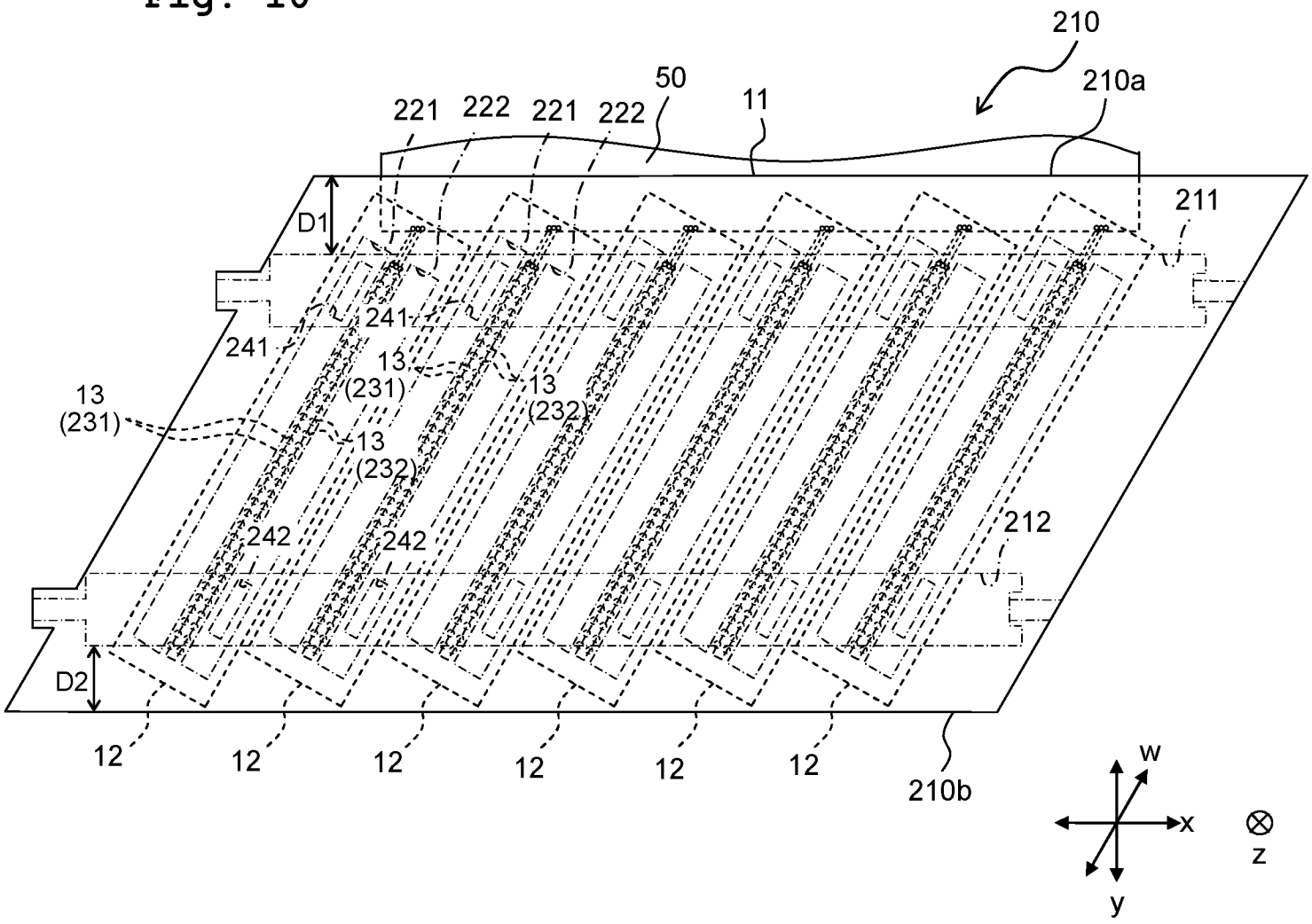
FIG. 10 is a view of a head according to a second embodiment of the present disclosure, corresponding to FIG. 2.

Next, an explanation will be given about a head according to a second embodiment of the present disclosure, with reference to FIG. 10.

The head of the second embodiment is different from the head 1 of the first embodiment in the number of the distributing channel and the number of the common channel. The head of the second embodiment has three channel members 210. In each of the three channel members 210, two distributing channels 211 and 212 are formed in a first part 11, and two common channels 221 and 222 are formed in each of six second parts 12.

The distributing channel 211 is communicated with the storing chamber 21 (see FIG. 1), and distributing channel 212 is communicated with the storing chamber 22 (see FIG. 1). The storing chambers 23 and 24 are omitted in the second embodiment.

The distributing channel 211 is communicated with six pieces of the common channel 221 via six holes 241, respectively. The distributing channel 212 is communicated with six pieces of the common channel 222 via six holes 242, respectively.

The lower surface of each of the second parts 12 is formed with 32 pieces of nozzle 231 communicating with the common channel 221 and 32 pieces of nozzle 232 communicating with the common channel 222.

The channel member 210 has a first end 210*a* which is one end in the y-direction, and a second end 210*b* which is the other end in the y-direction. A separation distance D1 in the y-direction between the first end 210*a* and the distributing channel 211 is greater than a separation distance D2 in the y-direction between the second end 210*b* and the distributing channel 212.

In the second embodiment, for example, the storing chamber 21 corresponds to the "storing chamber A", the distributing channel 211 corresponds to the "distributing channel A"; the storing chamber 22 corresponds to the "storing chamber B"; the distributing channel 212 corresponds to the "distributing channel B"; common channels 221 which are formed in two second parts 12 among the six second parts 12 correspond to the "common channel A1" and the "common channel A2", respectively; common channels 222 which are formed in the two second parts among the six second parts 12 correspond to the "common channel B1" and the "common channel B2", respectively; nozzles 231, formed in the two second parts 12 and corresponding to the common channels A1 and A2 (221), respectively, corresponds to the "nozzles A1" and the "nozzles A2", respectively; nozzles 232, formed in the two second parts 12 and corresponding to the common channels B1 and B2 (222), respectively, corresponds to "nozzles B1" and "nozzles B2", respectively; the holes 241, which connect the distributing channel 211 with the common channels 221 formed in the two second parts 12, correspond to the "connecting channel A1" and the "connecting channel A2", respectively; and the holes 242, which connect the distributing channel 212 with the common channels 222 formed in the two second parts 12, correspond to the "connecting channel B1" and the "connecting channel B2", respectively. In the above-described case, the distributing channel 211 is located at a position, in the y-direction, between the first end 210*a* of the channel member 210 and the distributing channel 212. The holes 241 are located at a position, in the y-direction, between the first end 10*a* of the channel member 10 and the holes 242.

According to the second embodiment, since the separation distance D1 is greater than the separation distance D2, it is possible to secure a connection area for the FPC 50, thereby making it possible to easily perform a connecting operation of the FPC 50.

Third Embodiment

Next, an explanation will be given about a head according to a third embodiment of the present disclosure, with reference to FIGS. 11 and 12.

A head 301 of the third embodiment is different from the head 1 of the first embodiment in the configuration of the FPC and the configuration of the wiring substrate. In the third embodiment, FPCs 350 are individually provided for driver ICs 40 of six second parts 12, respectively, as depicted in FIG. 11 (namely, six FPCs 350 are provided). A wiring substrate 360 is arranged at a position which is above the channel member 10, as depicted in FIG. 12, and at which the wiring substrate 360 sandwiches, in the z-direction, the distributing channels 111 to 114 between the wiring substrate 360 with the common channels 121 to 124.

The six FPCs 350 are provided with respect to the six second parts 12, respectively, whereas the wiring substrate 360 is provided for each of three pieces of the channel member 10.

Each of the six FPCs 350 has one end 350*a* connected to one of the drivers IC 40 corresponding thereto and the other end 350*b* connected to the wiring substrate 360. Terminals 350*t* of the FPCs 350 are provided on the one ends 350*a*, respectively. One end of each of the wirings 45 is connected to one of the terminals 350*t*, and the other end of each of the wirings 45 is connected to a terminal 40*t* of one of the drivers IC 40 corresponding thereto.

Figure 11:
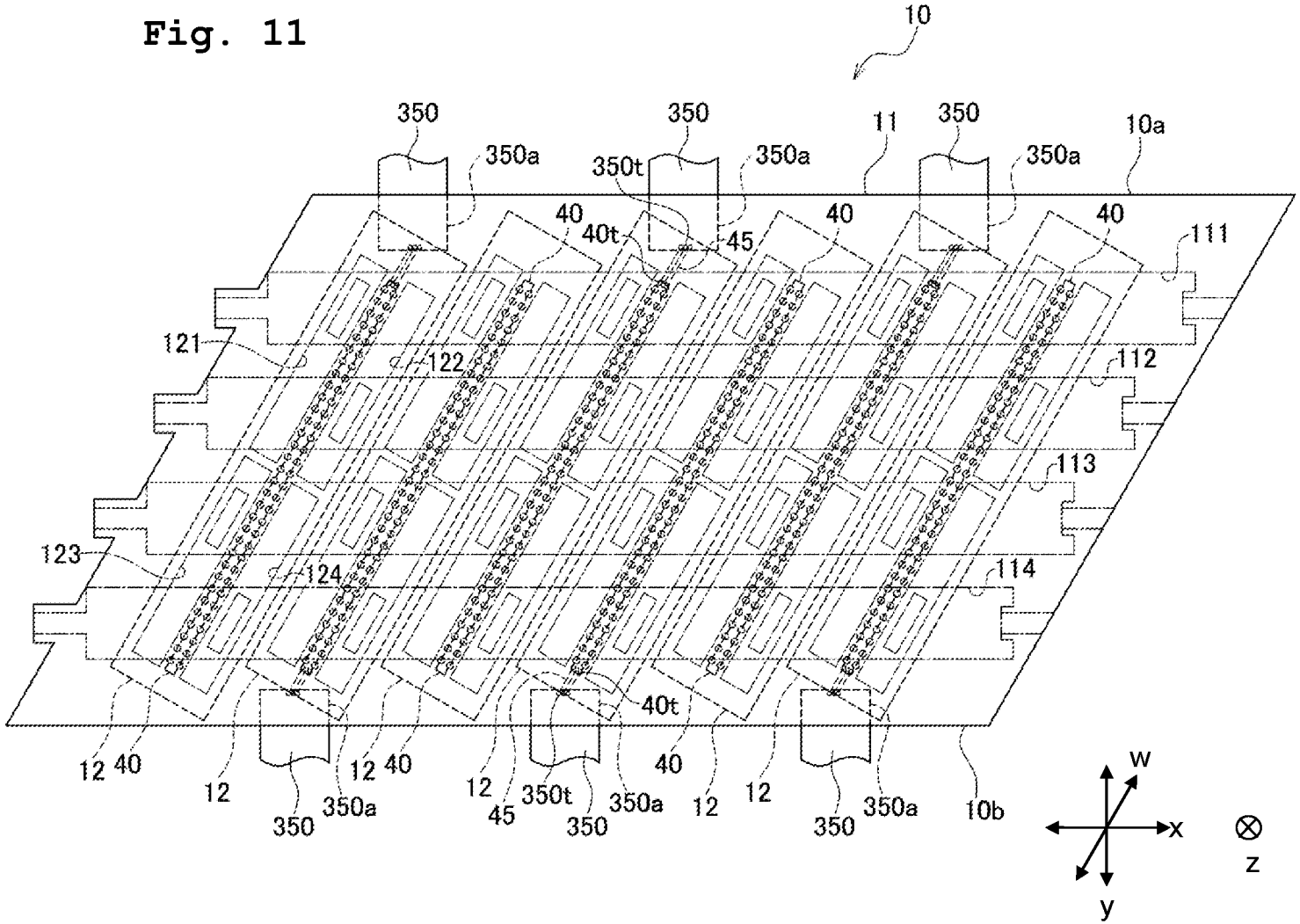
FIG. 11 is a view of a head according to a third embodiment of the present disclosure, corresponding to FIG. 2.

Among the six FPCs 350, one ends 350*a* of three FPCs 350, connected to drivers ICs 40 which are included in the six drivers ICs 40 and which are the first, third and fifth drivers ICs 40 from the left side in FIG. 11, are located, in the y-direction, between the first end 10*a* of the channel member 10 and the distributing channels 111 to 114. These three FPC 350 are drawn from the end 350*a* in a direction from the distributing channels 111 to 114 toward the first end 10*a*, along the y-direction.

Among the six FPCs 350, one ends 350*a* of three FPCs 350, connected to drivers ICs 40 which are included in the six drivers ICs 40 and which are the second, fourth and sixth drivers ICs 40 from the left side in FIG. 11, are located, in the y-direction, between the second end 10*b* of the channel member 10 and the distributing channels 111 to 114. These three FPC 350 are drawn from the end 350*a* in a direction from the distributing channels 111 to 114 toward the second end 10*b*, along the y-direction.

The other ends 350*b* of the six FPCs 350 are arranged in a zig-zag manner on the wiring substrate 360.

In the third embodiment, for example, the driver ICs 40 which are the first, third and fifth from the left in FIG. 11 each correspond to a "driving circuit", and the driver ICs 40 which are the second, fourth and sixth from the left in FIG. 11 each correspond to "another driving circuit"; three FPC 350 which are included in the six FPCs 350 and which are connected to the driver ICs 40 which are the first, third and fifth from the left in FIG. 11 each correspond to a "wiring member", and three FPC 350 which are included in the six FPCs 350 and which are connected to the driver ICs 40 which are the second, fourth and sixth from the left in FIG. 11 each correspond to "another wiring member".

Figure 12:
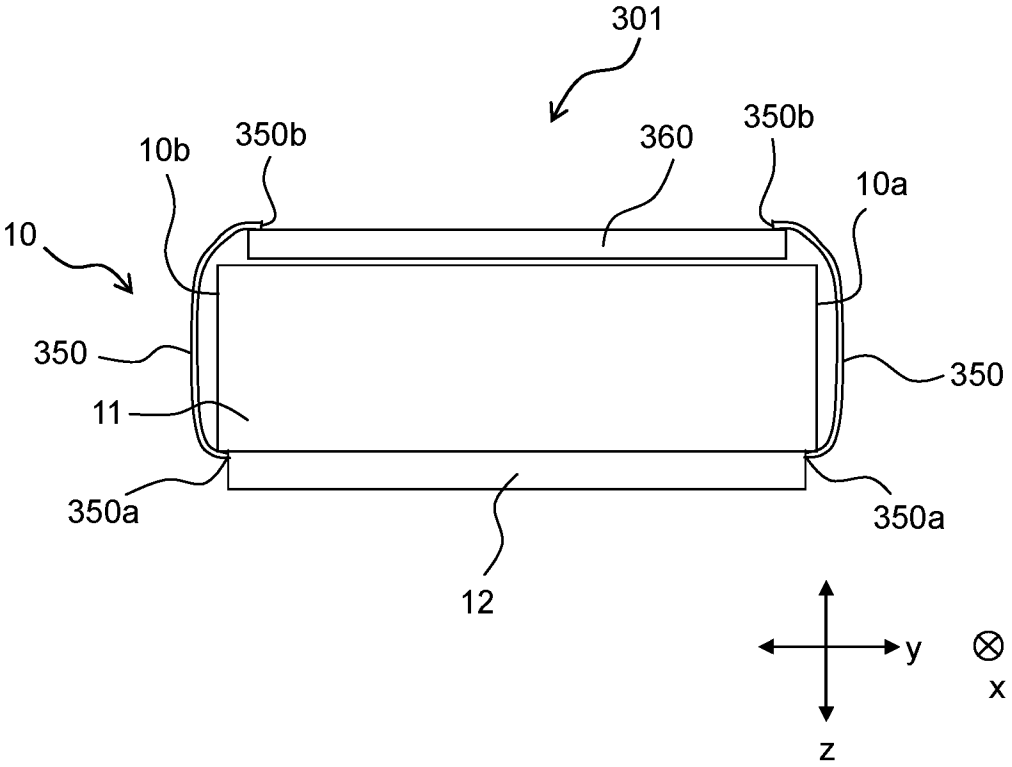
FIG. 12 is a side view of the head as depicted in FIG. 11.

According to the third embodiment, the wiring substrate 360 is arranged at a position at which the wiring substrate 360 sandwiches, in the z-direction, the distributing channels 111 to 114 between the wiring substrate 360 and the common channels 121 to 124, as depicted in FIG. 12. Accordingly, even in such a case that any leakage of ink occurs between the distributing channels 111 to 114 and the common channels 121 to 124, the leaked ink is less likely to adhere to the wiring substrate 360, which in turn suppress the occurrence of any short circuit.

Further, according to the third embodiment, two FPCs 350 connected to the drivers IC 40 which are arranged side by side in the x-direction are drawn in mutually opposite directions, respectively, as depicted in FIG. 11. In this case, it is possible to perform an operation of connecting the FPCs 350 more easily, as compared with a case in which these two FPCs 350 are drawn in a same direction.

Fourth Embodiment

Figure 13:
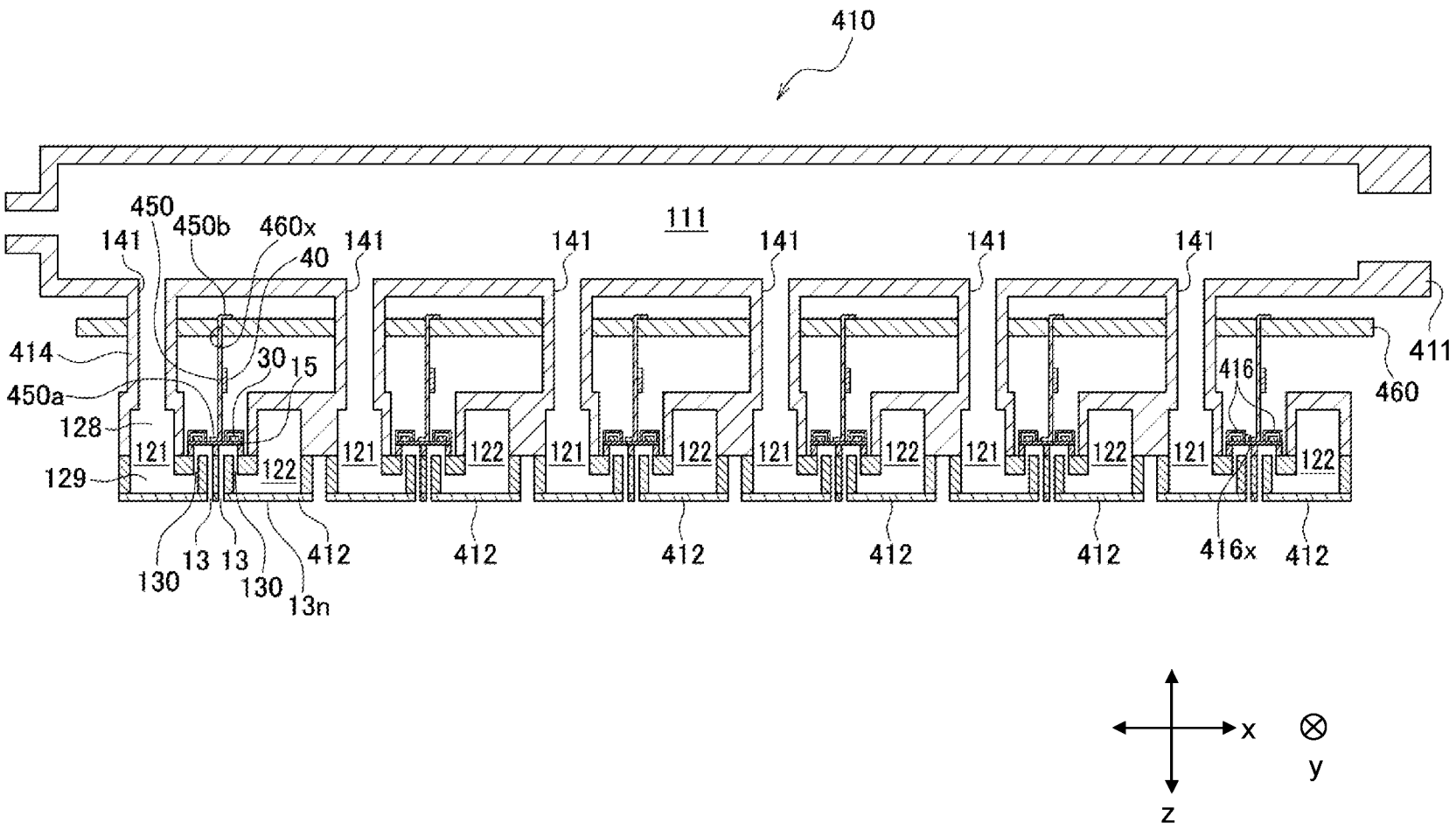
FIG. 13 is a view of a head according to a fourth embodiment of the present disclosure, corresponding to FIG. 6.

Next, an explanation will be given about a head according to a fourth embodiment of the present disclosure, with reference to FIG. 13.

The head of the fourth embodiment is different from the head 1 of the first embodiment in the configurations of the channel member, the wiring member and the wiring substrate.

A channel member 410 includes a first part 411 and six pieces of a second part 412 which are adhered to the lower surface (a surface facing downward in the z-direction) of the first part 411.

The first part 411 is formed with four distributing channels 111 to 114, holes 141 to 144 and communicating portions 128 for (to) the common channels 121 to 124, similarly to the first part 11 (FIGS. 2 and 6) of the first embodiment. Note that, however, the first part 411 is different from the first part 11 of the first embodiment in that the first part 411 has cylindrical portions 414 defining the holes 141 to 144, respectively, and extending in the z-direction.

Each of the second parts 412 is formed with lined-up portions 129 of the common channels 121 to 124, and individual channels 130 corresponding to the nozzles 13, respectively, similarly to the second parts 12 (FIGS. 2 and 6) of the first embodiment. Note that in each of the second parts 412, however, a cover plate 416 which is arranged on the upper surface of the vibration plate 15 has a groove 416*x* formed in the cover plate 416 at a central portion thereof in the x-direction.

As the wiring member in the third embodiment, a COF (Chip On Film) 450 is adopted, rather than the FPC. The COF 450 is provided as COFs 450 which are provided individually with respect to the six second parts 12, respectively, and each of which has one end 450*a* connected to the vibration plate 15 and the other end 450*b* connected to a wiring substrate 460. The one end 450*a* is arranged in the inside of the groove 416*x* of the cover plate 416. Each of the driver ICs 40 is mounted at a location between the one end 450*a* and the other end 450*b* of one of the COFs 450. Each of the COFs 450 is electrically connected to the piezoelectric elements 30 provided on the vibration plate 15.

The wiring substrate 460 is arranged, in the z-direction, between the distributing channels 111 to 114 and the common channels 121 to 124. The wiring substrate 460 is formed with six holes 460*x* through which the six COFs 450 are inserted, respectively. Further, the wiring substrate 460 is arranged so as not to interfere with the cylindrical portions 414 of the channel member 410.

According to the fourth embodiment, although the configurations of the channel member, the wiring member and the wiring substrate are different from those in the first embodiment, the fourth embodiment is provided with the configuration which is similar to that in the first embodiment, for example, in that the distributing channels 111 to 114 each extend in the x-direction, etc. Thus, it is possible to obtain effects similar to those obtained in the first embodiment.

Fifth Embodiment

Figure 14:
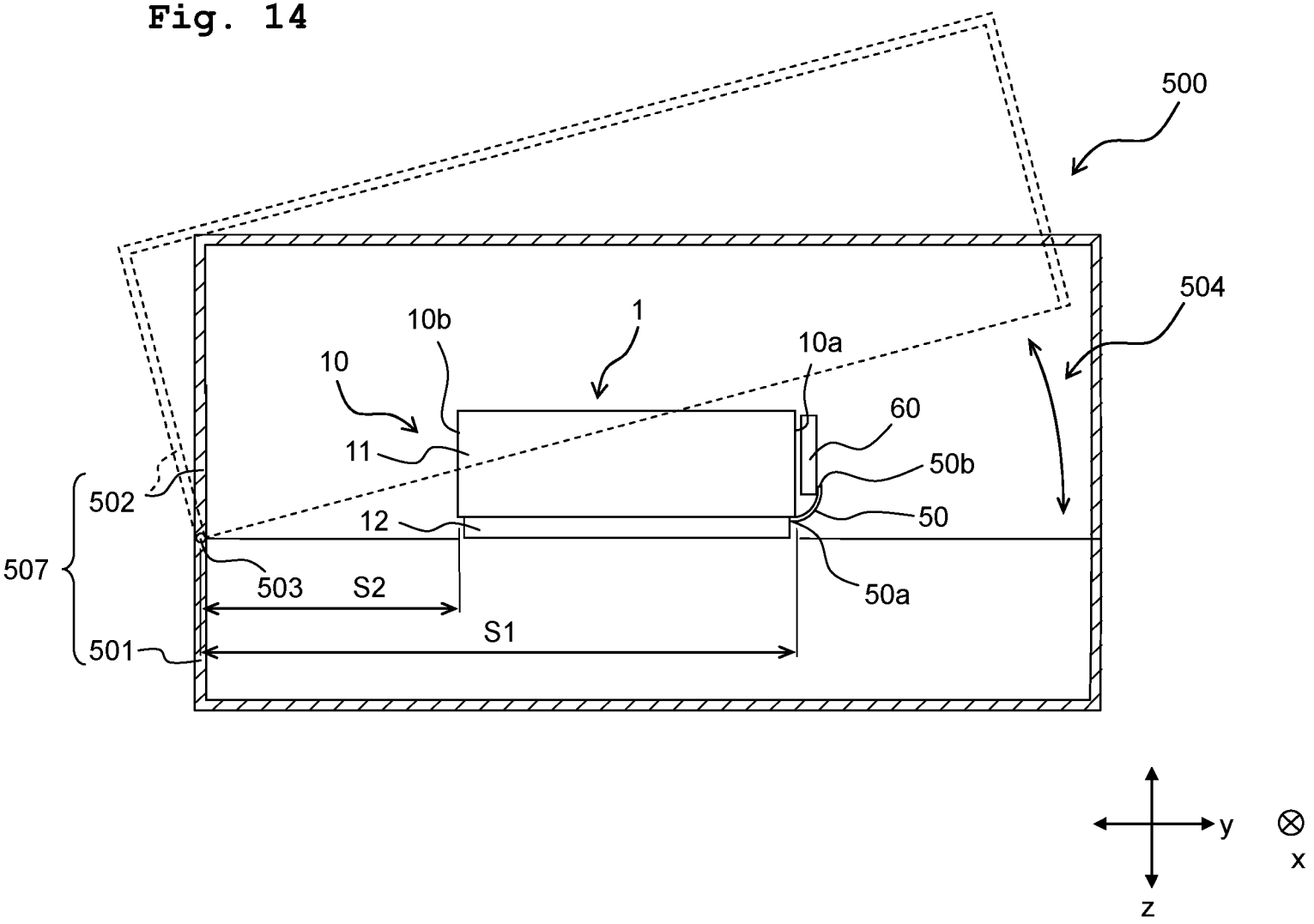
FIG. 14 is a cross-sectional view of a printer including a head according to a fifth embodiment of the present disclosure, corresponding to FIG. 9.

Next, an explanation will be given about a head according to a fifth embodiment of the present disclosure, with reference to FIG. 14.

The fifth embodiment is different from the first embodiment in the configuration of the casing.

A casing 507 of a printer 500 according to the fifth embodiment has a first casing 501 and a second casing 502. The second casing 502 is attached to the first casing 501 such that the second casing 502 is swingably movable relative to the first casing 501 about a swinging axis 503 along the x-direction. The second casing 502 is configured to swingably move about the swinging axis 503. Owing to this configuration, the second casing 502 is capable of assuming a state in which the second casing 502 defines an opening 504 (a state depicted in broken lines in FIG. 14) and a state in which the second casing 502 closes the opening 504 (a state depicted in solid lines in FIG. 14).

A separation distance S1 in the y-direction between the first end 10*a* of the channel member 10 and the swinging axis 503 is greater than a separation distance S2 in the y-direction between the second end 10*b* of the channel member 10 and the swinging axis 503.

According to the fifth embodiment, the vector of the direction from the channel member 10 toward the swinging axis 503 is opposite to the vector of the direction in which the FPC 50 is drawn from the channel member 10. Therefore, the FPC 50 is easily accessed via the opening 504 by allowing the second casing 502 to be in the state in which the second body 502 defines the opening 504, and thus an operation regarding the FPC 50 (maintenance operation, etc.) can be easily performed.

Although the embodiments of the present disclosure have been explained in the foregoing, the present disclosure is not limited to or restricted by the above-described embodiments; it is allowable to make various kinds of design changes to the present disclosure, within the scope described in the claims.

Modification

It is allowable that the check valve is not provided on the fitted portion of the channel member. For example, in FIG. 1, in a state that the three channel members 10 are assembled to one another and that the tubes 41 to 44 are attached to the channel member 10*z* which is on the leftmost side among the three channel members 10, the ink is prevented from being leaked from the fitted portion(s). Note that, however, it is preferred that the check valve is provided on one or two of the three channel members 10 so as to prevent any leakage of ink while performing exchange and/or maintenance for one or two of the three channel members 10.

The plurality of channel members are not being limited to being detachably attached to each other; it is allowable that the plurality of channel members are incapable of being detached from each other. It is allowable that the plurality of channel members do not have a same configuration. For example, in FIG. 1, only the channel member 10*x* which is on the rightmost side among the three channel members 10 is allowed to have a configuration that the other ends 111*b* to 114*b* of the distributing channels 111 to 114, respectively, are closed. Further, the liquid discharging head is not limited to being constructed of a plurality of channel members; it is also allowable that the liquid discharging head is constructed of one channel member.

The channel member is not limited to having a parallelogram-shaped in a plane orthogonal to the z-direction; it is allowable that the channel member has, for example, a rectangular shape.

In the first embodiment, it is allowable that the FPC 50 is provided individually for each of the six second parts 12. Further, in the first embodiment, it is allowable that the wiring substrate 60 is arranged at a location which is above the channel member 10 and at which the wiring substrate 60 sandwiches, in the z-direction, the distributing channels 111 to 114 between the wiring substrate 60 and the common channels 121 to 124.

The wiring member may be drawn, relative to the channel member, to the opposite side to the cover of the casing (the first embodiment), or drawn in a direction from the channel member toward the swinging axis (the fifth embodiment). Further, the wiring member may pass between the two distributing channels and may be drawn in the z-direction.

It is allowable that the distributing channel is formed in the first part, and that the communicating portions for (to) the common channels are not formed in the first part. Namely, it is allowable that the common channels is not formed across (spanning) in the first and second parts, and that the common channels are formed only in the second parts. Further, the channel member is not limited to being constructed of the first and second parts; it is allowable that the channel member is constructed of a single part (a part formed of a same material (such as a resin, metal, etc.)) in which the distributing channels and the common channels are formed.

The driving element is not limited to being the piezoelectric element; the driving element may be, for example, an actuator of the thermal system.

The x-direction may be a direction along the nozzle surface, and is not limited to being the longitudinal direction of the head. The x-direction may be, for example, a width direction of the width of the head.

The liquid discharging head is not limited to being the head discharging (jetting) a plurality of color inks; the liquid discharging head may discharge a single color ink. For example, the two kinds of liquids are not limited to having mutually different colors; the two kinds of liquids may be different from each other in elements thereof other than the colors. For example, one of the two kinds of liquids may be an ink, and the other of the two kinds of liquids may be a treatment agent which causes an component of the ink to aggregate or deposit. Each of the two kinds of liquids are not limited to being an ink, and may be any liquid (the above-described treatment liquid, etc.).

The liquid discharging head it not limited to being a head of the line system, and may also be a head of the serial system.

The object (target) of discharge is not limited to paper sheet (paper), and may be, for example, cloth, a substrate, etc.

The present disclosure is not limited to or restricted by being applicable to a printer, and may be applicable also to a facsimile machine, copying machine, a multi-functional peripheral, etc. Further, the present disclosure is applicable also to a liquid discharging apparatus usable in a variety of kinds of usage or application other than recording of image, etc. For example, it is possible to apply the present disclosure to a liquid discharging apparatus configured to form a conductive pattern on a substrate by discharging or jetting a conductive liquid onto the substrate.

What is claimed is:

1. A liquid discharging head comprising a channel member having a nozzle surface in which first nozzles, second nozzles, third nozzles and fourth nozzles are formed, the channel member being formed with:

a first distributing channel communicating with a first storage chamber configured to store a first liquid and extending in a first direction along the nozzle surface;

a second distributing channel communicating with a second storage chamber configured to store a second liquid, extending in the first direction, and arranged side by side to the first distributing channel in a second direction orthogonal to the first direction and along the nozzle surface;

a first common channel communicating with the first nozzles, extending in a third direction crossing the first and second directions and along the nozzle surface, and having a portion overlapping with the first distributing channel in a fourth direction orthogonal to the nozzle surface and another portion overlapping with the second distributing channel in the fourth direction;

a second common channel communicating with the second nozzles, extending in the third direction, and having a portion overlapping with the first distributing channel in the fourth direction and another portion overlapping with the second distributing channel in the fourth direction;

a third common channel communicating with the third nozzles, extending in the third direction, and having a portion overlapping with the first distributing channel in the fourth direction and another portion overlapping with the second distributing channel in the fourth direction;

a fourth common channel communicating with the fourth nozzles, extending in the third direction, and having a portion overlapping with the first distributing channel in the fourth direction and another portion overlapping with the second distributing channel in the fourth direction;

a first connecting channel connecting the first distributing channel with the first common channel;

a second connecting channel connecting the first distributing channel with the second common channel;

a third connecting channel connecting the second distributing channel with the third common channel; and a fourth connecting channel connecting the second distributing channel with the fourth common channel, wherein the channel member has a first end which is one end in the second direction and a second end which is the other end in the second direction, the first distributing channel is located, in the second direction, between the first end of the channel member and the second distributing channel, and the first and second connecting channels are located, in the second direction, between the first end of the channel member and the third and fourth connecting channels.

2. The liquid discharging head according to claim 1, wherein the third common channel is located, in the first direction, between the first common channel and the second common channel, and the second common channel is located, in the first direction, between the third common channel and the fourth common channel.

3. The liquid discharging head according to claim 1, further comprising:

a driving circuit provided on the channel member and configured to drive at least a part of driving elements configured to cause liquid to be discharged from the first nozzles, the second nozzles, the third nozzles and the fourth nozzles, respectively;

a wiring member having one end connected to the driving circuit and the other end; and a wiring substrate connected to the other end of the wiring member, and arranged at a position at which the wiring substrate sandwiches, in the second direction, the first end of the channel member between the wiring substrate and the first and second distributing channels.

4. The liquid discharging head according to claim 1, further comprising:

a driving circuit provided on the channel member and configured to drive at least a part of driving elements configured to cause liquid to be discharged from the first nozzles, the second nozzles, the third nozzles and the fourth nozzles, respectively;

a wiring member having one end connected to the driving circuit and the other end; and a wiring substrate connected to the other end of the wiring member, and arranged at a position at which the wiring substrate sandwiches, in the fourth direction, the first distributing channel and the second distributing channel between the wiring substrate and the first common channel, the second common channel, the third common channel and the fourth common channel.

5. The liquid discharging head according to claim 3, wherein the one end of the wiring member is located, in the second direction, between the first end of the channel member and the first and second distributing channels, and the wiring member is extended from the one end of the wiring member in a direction from the first and second distributing channels toward the first end of the channel member, along the second direction.

6. The liquid discharging head according to claim 5, wherein a separation distance in the second direction between the first end of the channel member and the first distributing channel is greater than a separation distance in the second direction between the second end of the channel member and the second distributing channel.

7. The liquid discharging head according to claim 5, wherein the channel member further has a third end which is one end in the first direction and a fourth end which is the other end in the first direction, an angle defined by the first end and the third end of the channel member is an obtuse angle, an angle defined by the first end and the fourth end of the channel member is an acute angle, and a distance from a connection portion between the first and third ends of the channel member to the one end of the wiring member is smaller than a distance from a connection portion between the first and fourth ends of the channel member to the one end of the wiring member.

8. The liquid discharging head according to claim 5, further comprising:

a casing in which the channel member, the driving circuit, the wiring member and the wiring substrate are arranged, and which has a first side wall constructing one end in the second direction of the casing and a second side wall constructing the other end in the second direction of the casing;

an opening formed in the first side wall; and a cover attached to the first side wall and movable between an open position where the opening is not covered by the cover and a closed position where the opening is covered by the cover, wherein a separation distance in the second direction between the first end of the channel member and the first side wall is smaller than a separation distance in the second direction between the second end of the channel member and the first side wall.

9. The liquid discharging head according to claim 5, further comprising a casing in which the channel member, the driving circuit, the wiring member and the wiring substrate are arranged, and which has a first casing and a second casing attached to the first casing such that the second casing is swingably movable relative to the first casing about a swinging axis along the first direction, the second casing being configured to have a state in which the second casing defines an opening and a state in which the second casing closes the opening, wherein a separation distance in the second direction between the first end of the channel member and the swinging axis is greater than a separation distance in the second direction between the second end of the channel member and the swinging axis.

10. The liquid discharging head according to claim 4, wherein the driving circuit drives the part of the driving elements, the liquid discharging head further comprising:

another driving circuit provided on the channel member and configured to drive at least another part of the driving elements which is different from the part of the driving elements, the another driving circuit being arranged side by side to the driving circuit in the first direction; and another wiring member having one end connected to the another driving circuit and the other end connected to the wiring substrate, the one end of the another wiring member is located, in the second direction, between the second end of the channel member and the distributing channels A and B, and the another wiring member is drawn from the one end of the another wiring member in a direction from the distributing channels A and B toward the second end of the channel member, along the second direction.

11. The liquid discharging head according to claim 1, further comprising:

a wiring member having one end connected to the channel member and the other end, the wiring member having a driving circuit mounted thereon, the driving circuit configured to drive at least a part of driving elements configured to cause liquid to be discharged from the first nozzles, the second nozzles, the third nozzles and the fourth nozzles, respectively; and a wiring substrate connected to the other end of the wiring member, and arranged at a position, in the fourth direction, between the first and second distributing channels and the first, second, third and fourth common channels.

12. The liquid discharging head according to claim 1, wherein the first, second, third and fourth common channels have:

communicating portions communicating with the first, second, third and fourth connecting channels, respectively; and lined-up portions arranged side by side respectively to the communicating portions in the fourth direction, and the channel member has:

a first part formed with at least one of the first and second distributing channels, and the communicating portion of at least one of the first, second, third and fourth common channels; and a second part adhered to the first part and formed with the lined-up portion which is included in the lined-up portions of the first, second, third and fourth common channels and which is arranged side by side, in the fourth direction, to the communicating portion formed in the first part.

13. The liquid discharging head according to claim 1, further comprising another channel member which is arranged side by side to the channel member in the first direction, the another channel member being formed with:

a third distributing channel communicating with the first storage chamber and arranged side by side to the first distributing channel in the first direction; and a fourth distributing channel communicating with the second storage chamber and arranged side by side to the second distributing channel in the first direction, wherein the first distributing channel has one end in the first direction and the other end in the first direction, the third distributing channel has one end in the first direction and the other end in the first direction, the second distributing channel has one end in the first direction and the other end in the first direction, the fourth distributing channel has one end in the first direction and the other end in the first direction, a first fitting portion constructing the one end of the first distributing channel in the channel member has a shape fittable to a first fitted portion constructing the other end of the third distributing channel in the another channel member, a second fitting portion constructing the one end of the second distributing channel in the channel member has a shape fittable to a second fitted portion constructing the other end of the fourth distributing channel in the another channel member, and the channel member and the another channel member are detachably attachable to each other.

* * * * *